US007913771B2

(12) United States Patent
White

(10) Patent No.: US 7,913,771 B2
(45) Date of Patent: Mar. 29, 2011

(54) BATTERY OPERATED CORDLESS VIBRATORY PILE DRIVER

(75) Inventor: John L. White, Seattle, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 137 days.

(21) Appl. No.: 12/341,672

(22) Filed: Dec. 22, 2008

(65) Prior Publication Data

US 2009/0200055 A1 Aug. 13, 2009

Related U.S. Application Data

(60) Provisional application No. 61/016,056, filed on Dec. 21, 2007.

(51) Int. Cl.
*E02D 7/18* (2006.01)

(52) U.S. Cl. ..... 173/49; 173/43

(58) Field of Classification Search ..... 173/49, 173/43

See application file for complete search history.

(56) References Cited

U.S. PATENT DOCUMENTS 3,828,864 A * 8/1974 Haverkamp et al. ..... 173/49
3,920,083 A * 11/1975 Makita ..... 173/49
4,050,527 A * 9/1977 Lebelle ..... 173/49
4,061,196 A * 12/1977 Herz ..... 173/49
4,100,974 A * 7/1978 Pepe ..... 173/49
4,113,034 A * 9/1978 Carlson ..... 173/49
4,143,719 A * 3/1979 Furukawa et al. ..... 173/1
4,625,811 A * 12/1986 Tuenkers ..... 173/49
5,027,908 A * 7/1991 Roussy ..... 173/49
5,088,565 A * 2/1992 Evarts ..... 173/49
5,165,488 A * 11/1992 Liu ..... 173/49
5,177,386 A * 1/1993 Shimada ..... 310/81
5,355,964 A * 10/1994 White ..... 173/1
5,755,293 A * 5/1998 Bourke ..... 173/29
5,771,985 A * 6/1998 Jaworski ..... 175/55
6,386,295 B1 * 5/2002 Suver ..... 173/1
6,634,439 B2 * 10/2003 Driessen ..... 173/217
7,032,685 B2 * 4/2006 Nakamizo ..... 173/93.5
7,314,098 B2 * 1/2008 Miller ..... 173/49
2002/0020539 A1 * 2/2002 Driessen ..... 173/216
2005/0023017 A1 * 2/2005 Sakai ..... 173/201
2005/0192519 A1 * 9/2005 Crunick ..... 601/72
2006/0113456 A1 * 6/2006 Miller ..... 248/545

* cited by examiner

*Primary Examiner* — Brian D Nash
(74) *Attorney, Agent, or Firm* — Madson IP, P.C.

(57) ABSTRACT

A cordless vibratory pile driver ("vibro") may use one or more batteries to provide the requisite power. The cordless vibro may sit in a stand that also recharges the unit while it is in the stand when the device is not in use. The replaceable batteries are mounted as part of the suppressor housing on top of the housing that contains the eccentrics. The batteries are balanced on both sides to distribute the weight evenly. A small battery powered electric hydraulic pump sits in the suppressor housing to provide oil to open and close the jaws. A digital hand held remote control sends the necessary signals to the machine to open and close the jaw and to start and stop the vibration.

11 Claims, 3 Drawing Sheets

BATTERY OPERATED CORDLESS VIBRATORY PILE DRIVER

CROSS-REFERENCED RELATED APPLICATIONS

This patent application claims the benefit of U.S. Provisional Patent Application Ser. No. 61/016,056 that was filed on Dec. 21, 2007, for an invention titled, BATTERY OPERATED CORDLESS VIBRATORY. Such provisional application is expressly incorporated herein by this reference.

BACKGROUND OF THE INVENTION

A vibratory pile driver (which is sometimes called a "vibro") is a machine that is used to drive piles as part of deep foundation construction jobs. Typical examples of vibros are disclosed in U.S. Pat. Nos. 5,609,380, 5,117,925, and U.S. Pat. No. 5,263,544. These patents are expressly incorporated herein by reference.

Currently, all vibros on the market today are either powered by a hydraulic power pack with long hoses leading to the hydraulic motor on the vibro, or they are powered by a power unit that is diesel engine over electrical generator (electric wires leading to vibro).

The Russians invented the first electric powered vibro in the 1920's. A diesel engine rotating an electric generator was the power source or the power came from wires hooked into the street electrical grid. The electrical wires leading to the vibro were dangerous, sparking on steel piles and causing shorts and the need for electricians full time on the job. In the late 1960's a USA company invented the first vibro powered by a hydraulic motor. The motor also needed lines or hoses leading to the machine from the hydraulic power unit. All through the early 1970's a war between electric vibros and hydraulic vibros occurred. The hydraulic machines were sold on safety, having no electrical wires to short out on piles. The hydraulic machines could also go underwater, which was impossible for an electrical machine. Accordingly, after they were introduced into the market, hydraulic vibros were sold as fast as they could be built because most workers hated those electrical wires and preferred working with the new hydraulic hoses.

However, in either case, hydraulic or electric, there are still wires or hoses leading to the vibro from the power unit. These wires or hoses create problems. For example, in most cases these hoses are, at maximum, 100 feet long. The maximum the crane operator can reach before relocation of the power unit is limited by the length of hoses. Thus, time is often wasted at the job site while the workers are hassled with moving the hoses.

Further, as hoses are added to the system, horsepower and efficiency is decreased. The power unit is powered by a diesel engine, which requires fuel, oil, water, and other maintenance, not to mention that it takes time to move it around with the hoses.

The hoses are a constant cause of failure due to damage. Replacing the hoses is a danger because it is difficult to fix a damaged hydraulic hose in job site conditions without introducing dirt into the system while changing or fixing the broken lines. The hoses may also twist up and cause more problems. The hoses are expensive and require special fittings that vary in size and type, causing unwanted downtime as the mechanic searches for the correct type of fitting: There are a variety of different fittings (such as JIC, Pipe, German, French, etc.). Accordingly, it can be expensive to find and replace a broken fitting on a hose. Remote parts of the world do not even have the necessary fittings so the machine suffers downtime if a fitting is broken. In fact, if no fitting can be found in these remote areas, dangerous makeshift fittings must be used. These makeshift fittings can lead to injury on the jobsite.

Some jobs require that all hydraulic hoses be in new condition, rendering perfectly good hoses that may have a small blemish or tear as rejected. This can get very expensive. Contractors are faced with replacing all hoses to do a job. Also, the contractor must keep a supply of new, additional hoses in the event that one of the hoses gets a blemish. Of course, storing a supply of new hoses on a jobsite is difficult because the hoses can become lost, become contaminated with dirt, etc.

Hoses also become bare, exposing the wire core, which can cut the hands while handling. High pressure leaks can inject oil into the skin and cause sickness or even death. Hoses can fall on the pile crew while handling them. Hoses can swing into people or crush people. Hoses can get caught on things while the crane operator is swinging. Hands can get caught into them while they are being lifted.

There are usually five hoses in the lines leading from the power unit to the vibro. These hoses are usually banded every four feet to keep them in order. These bands break over time and the hoses become tangled and difficult to work with.

Broken hoses can cause a sudden loss of pressure in the clamp lines, which can cause the clamp to fail. If the clamp fails, the pile can drop suddenly. Falling piles can cause injury or even death.

Accordingly, there are a variety of disadvantages associated with working with hoses on vibros. Elimination of the hoses used on a vibro, whether electric lines or hydraulic lines, could be a great benefit. It would significantly reduce the hassles associated with working with a vibro. The present embodiments teach a new type of cordless, "hoseless" vibro that will address one or more of the above-recited problems.

BRIEF SUMMARY OF THE INVENTION

The vibro is a cordless vibro that sits in a stand that also recharges the unit while it is in the stand, much like a cordless toothbrush or shaver. The replaceable batteries are mounted as part of the suppressor housing. The weight of the batteries is used as an engineering plus, since the suspension system on a vibro requires dampening weight in order to make the rubber suppressors work properly. Normally this dampening weight is large plates of steel. In this embodiment, the suppressor is made very light as the battery weight is used as the dampening weight. The batteries are balanced on both sides to distribute the weight evenly. A small battery powered electric hydraulic pump sits in the suppressor housing to provide oil to open and close the jaws. A digital hand held remote control sends the necessary signals to the machine to open and close the jaw and to start and stop the vibration.

Pictures of an exemplary embodiment of a cordless vibro are attached to the provisional application to which this application claims priority and which has been incorporated by reference into this application. As will be appreciated by those skilled in the art, there are a variety of different advantages of using a cordless vibro, including but not limited to: 1) the use of one or more electric motors powered by rechargeable batteries; 2) no hydraulic power unit is necessary to run the machine, thereby making the machine more environmentally friendly; 3) no diesel engine exhaust is created; 4) no diesel engine noise is created; 5) the batteries may be recharged when the hammer is placed in a charger or "travel stand" while not in use; 6) the travel stand may also be used to charge extra (spare) battery(ies); and 7) batteries are easily and quickly replaceable for a fresh charge.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawing(s). Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1B:
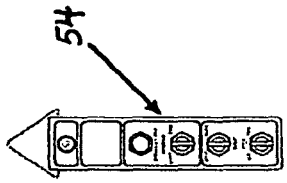
FIG. 1B is a schematic view of a handheld remote control for operating the cordless vibro.

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the drawing(s), is not intended to limit the scope of the invention, as claimed, but is merely representative of presently preferred embodiments of the invention.

Figure 1A:
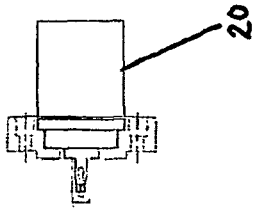
FIG. 1A is a schematic side view of an electric motor for inclusion in the cordless vibro.
Figure 1:
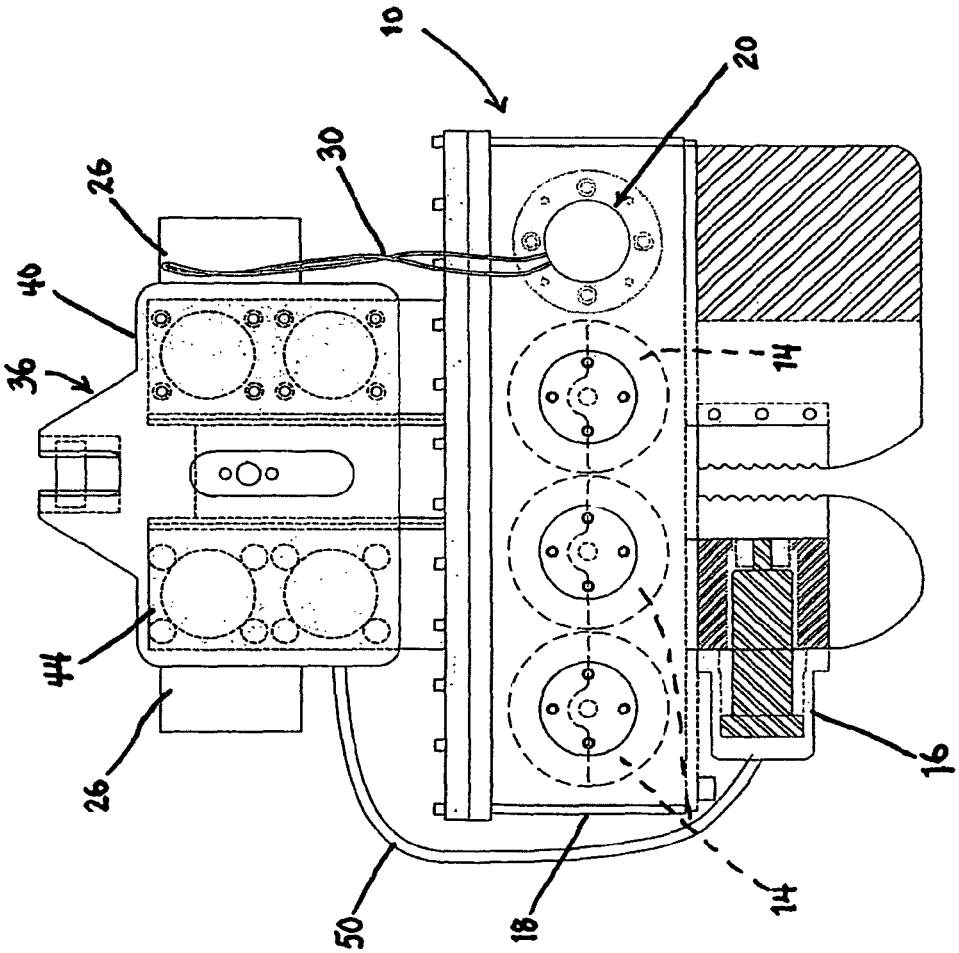
FIG. 1 is a schematic view of a new cordless vibro.

FIG. 1 is a schematic that illustrates a cordless vibratory hammer 10 (also called the vibro 10) that may be used to drive a pile. As with other types of vibratory hammers, the vibro 10 includes eccentrics 14 that will rotate and will produce force sufficient to drive a pile. The eccentrics 14 may be housed within a gear box 18. Of course, an electric motor 20 may be used to drive/turn the eccentrics 14. In the embodiment of FIG. 1, this motor is a 24V electric motor. This motor is used for smaller types of vibros. Larger vibros may incorporate a larger, more powerful electric motor, as desired.

The above-recited patents (which were incorporated herein by reference) explain how this type of pile-driving may occur. In order to engage the pile (not shown), a standard type of jaw/clamp system 16 may be used. Those skilled in the art will appreciate how the jaw/clamp system operates.

In order to power the motor 20 (also shown in FIG. 1A), one or more batteries 26 may be used. In the embodiment shown in FIG. 1, the batteries 26 comprise rechargeable batteries in a 24 volt battery pack. Other types of batteries may be used. More powerful batteries may be required to supply power to larger motors. Those skilled in the art will appreciate how the various battery packs/batteries may be selected to correspond to the appropriate size/type of motor. In order to supply power from the batteries 26 to the motor 20, one or more electrical 30 wires may be used.

The vibro 10 includes a suppressor 36 mounted above the gear box 18. The suppressor 36 includes an outer housing 40 and an inner housing 44. The batteries 26 are mounted to the outer housing 40. Specifically, two batteries 26 are mounted to either end of the outer suppressor housing 40. The weight of the batteries 26 is used as an engineering plus, since the suspension system on a vibro requires dampening weight in order to make the rubber suppressors work properly. Normally this dampening weight is large plates of steel. In this embodiment, the suppressor 36 is made very light as the battery weight is used as the dampening weight. The batteries 26 are balanced on both sides to distribute the weight evenly.

A small battery powered electric hydraulic pump (not shown) sits in the suppressor housing 44 to provide oil to open and close the jaws via a hose 50. Those skilled in the art will appreciate how this electric hydraulic pump may be configured. This pump may receive power from the batteries 26.

A handheld remote control 54 (which may be digital) sends the necessary signals to the vibro 10 to open and close the jaw and to start and stop the vibration. FIG. 1B is a schematic of a type of handheld remote control 54. Of course, those skilled in the art will appreciate how the handheld remote control 54 operates to control the various functions of the vibro 10.

Vibros rarely run all day, so a battery-powered vibro will work. In addition, just as a cordless drill has a spare battery always on the ready, so can this cordless vibro 10. One battery 26 (or set of batteries) may be used in the vibro 10 and one battery 26 (or one set of batteries) may be placed in a charger 70 (see FIG. 2). This charger 70 may be a travel stand 60 that is designed to house/support the vibratory hammer 10 while not in use. Most jobsites have a 110 volt power source to run the job shack (or supply house) so one can simply plug the travel stand 60 (or battery charger 70) into a power source (such as a 110V power source) to charge the spare battery 26. In addition, each time the vibro 10 is set down it should be set into the travel stand 60 so the main battery 26 charges, which will operate to charge the battery 26. Thus, after hours, the batteries 26 may be recharged overnight so that they will be ready for use the following morning. Remote areas without a power source can receive a travel stand 60 with a small electrical generator (not shown) that keeps the standby battery 26 fully charged. By charging the battery(ies) 26 in this manner, there will always be sufficient charge to operate the vibro 10.

It should be noted that the embodiment shown in FIG. 1 is a small vibro 10, which provides about 30 inch/pounds of force. Much larger vibros 10 may also be made using cordless technology. Such larger models may require one or more larger batteries 26, such as the batteries 26 used to power a car/vehicle/forklift. (The two batteries 26 used to power some forklifts are prime examples of these types of battery systems). Other types of large batteries 26 may also be used.

Today's battery technology and the fact that fast replacement batteries 26 are available, one can see that a cordless vibro is the next great leap forward in the pile driving world. Add to this a cordless drill, a cordless impact hammer and you have a new generation of pile driving machines taking advantage of the new battery technology coming into play.

More importantly, those skilled in the art will appreciate that the present cordless embodiments eliminate the hoses, and the problems associated with hoses, discussed above.

Figure 2:
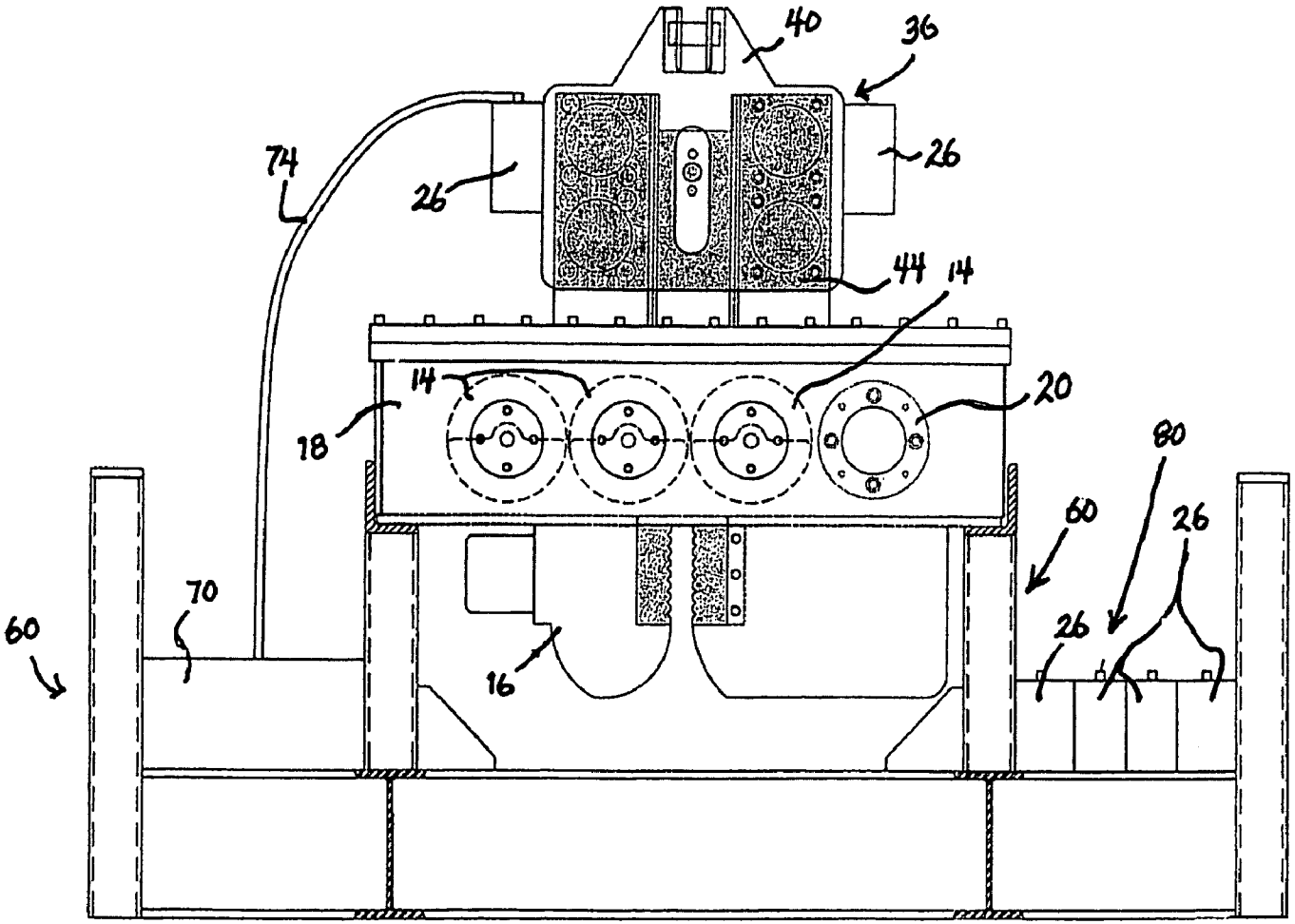
FIG. 2 is a schematic view of the embodiment of FIG. 1 resting in a shipping stand.

FIG. 2 is a schematic drawing that shows the cordless vibro 10 of FIG. 1. However, in this drawing, the vibro 10 is seated in a "stand" or frame 60. (This stand 60 may also be called a "travel stand" because it may be portable, carried to the jobsite, etc.). The stand 60 is shaped/designed to receive/house the vibro 10 when it is not in use. It will be appreciated that a variety of different shapes/configurations may be constructed so that the stand 60 receives the vibro 10. It will also be appreciated that only a portion of the vibro 10 may actually be seated within the stand 60, as desired. Of course, the exact configuration of the stand 60 shown in FIG. 2 is not limiting; any type of stand 60 or frame that receives all or a portion of the vibro 10 may be used.

A battery recharger 70 may be part of the stand 60. The battery recharger 70 is designed to recharge the battery(ies) 26 when the vibro 10 is placed in the stand 60. (In order to accomplish this re-charging, the recharger 70 must be plugged into a voltage source such as a wall unit, an electric generator, etc.). In other words, when the vibro 10 is placed in the stand 60, power from the recharger 70 is sent to the battery(ies) 26 to recharge these units via wiring 74. Thus, by placing the vibro 10 in the stand 60 for a specified period of time (i.e., 3 hours, overnight, 6 hours, etc.), the vibro 10 will be ready for a new use.

It should be noted that the position of the wires 74 is shown for illustrative purposes only. It will be appreciated that other configurations, locations, for the wiring 74 may also be used, as desired. Other embodiments may be designed in which the vibro 10 will simply "lock" or snap-fit into the stand 60, and when such snap-fitting occurs, the batteries 26 are automatically connected to the recharger 70 so that they may be recharged.

In further embodiments, the recharger 70 is separate from the stand 60. In this embodiment, the user will simply plug the recharger 70 into the battery(ies) 26 and the power source to effectively charge the battery(ies) 26.

In the embodiment of FIG. 2, the stand 60 may also include a spare battery receiving area 80. This area 80 is designed to receive and house one or more spare batteries 26. When housed in the area 80, these batteries 26 are charged by the recharger 70. Accordingly, the user will generally always have one or more spare batteries 26 that are fully charged in the event that such batteries 26 are needed. That way, if the battery 26 runs out on a job-site, the battery 26 may be quickly replaced with a fully-charged battery 26 from the receiving area 80. Again, the size and number of batteries 26 that may fit into the receiving area 80 may vary depending upon the particular embodiment.

Figure 3:
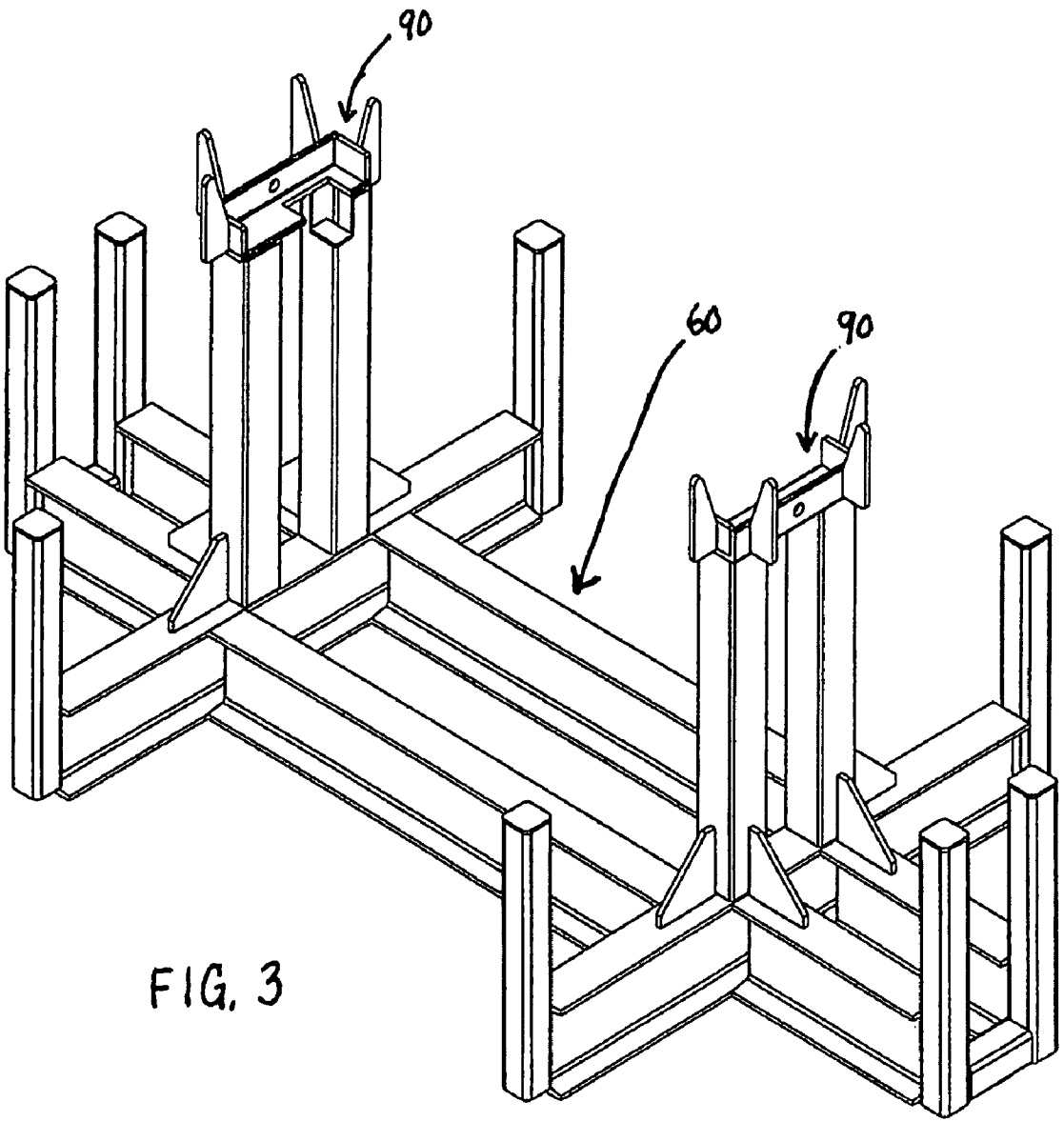
FIG. 3 is a schematic view of an embodiment of the stand.

FIG. 3 is a depiction of an embodiment of the stand 60. The stand 60 may include a receiving area 90 into which the vibro 10 will fit. As explained above, this receiving area 90 holds the vibro 10 for storage and also allows the battery(ies) 26 to be charged. Those of skill in the art will appreciate that the representation of FIG. 3 is but one example of the different types of stands that may be used.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A vibratory pile driver system for driving a pile comprising:

a first eccentric and a second eccentric housed within an eccentric housing;

a motor capable of rotating the first eccentric and the second eccentric to create a vibratory force for driving the pile;

one or more batteries that provides power to the motor; and a battery-powered electric hydraulic pump, a hose, and a clamping jaw, the electric hydraulic pump and hose operate to provide hydraulic fluid to open and close the clamping jaw.

2. A vibratory pile driver system as in claim 1 further comprising a stand that is capable of charging the batteries.

3. A vibratory pile driver system as in claim 2 wherein the stand holds the eccentric housing in an upright disposition.

4. A vibratory pile driver system as in claim 1 further comprising a remote control that operates the pile driver.

5. A vibratory pile driver system as in claim 4 wherein the remote control operates to turn the motor off and on.

6. A vibratory pile driver system as in claim 4 wherein the remote control operates to open and close the clamping jaw.

7. A vibratory pile driver system as in claim 1 further comprising a suppressor having a suppressor housing, wherein the batteries are evenly distributed on the suppressor housing thereby providing dampening weight.

8. A vibratory pile driver system as in claim 7 wherein the suppressor comprises suppressor rubbers.

9. A vibratory pile driver system as in claim 1 wherein each of the one or more batteries is at least a 24V battery.

10. A vibratory pile driver system for driving a pile comprising:

a first eccentric and a second eccentric housed within an eccentric housing;

a motor capable of rotating the first eccentric and the second eccentric to create a vibratory force for driving the pile;

one or more batteries that provides power to the motor; and a remote control that operates the pile driver.

11. A vibratory pile driver system for driving a pile comprising:

a first eccentric and a second eccentric housed within an eccentric housing;

a motor capable of rotating the first eccentric and the second eccentric to create a vibratory force for driving the pile;

one or more batteries that provides power to the motor; and a suppressor having a suppressor housing, wherein the batteries are evenly distributed on the suppressor housing thereby providing dampening weight.

* * * * *